United States Patent [19]

Günter

[11] 4,433,752

[45] Feb. 28, 1984

[54] RESCUE SYSTEM ON HIGH-RISE BUILDINGS

[75] Inventor: Franz-Josef Günter, Grevenbroich, Fed. Rep. of Germany

[73] Assignee: Walther & Cie. Aktiengesellschaft, Cologne-Dellbrück, Fed. Rep. of Germany

[21] Appl. No.: 311,304

[22] Filed: Oct. 14, 1981

[30] Foreign Application Priority Data

Nov. 14, 1980 [DE] Fed. Rep. of Germany ..... 3042953

[51] Int. Cl.[3] ..... A62B 1/02; B66B 9/00

[52] U.S. Cl. ..... 182/82; 182/142; 187/6

[58] Field of Search ..... 182/82, 36, 37, 142, 182/143; 187/6, 19

[56] References Cited

U.S. PATENT DOCUMENTS

| | | | |
|---|---|---|---|
| 287,549 | 10/1883 | King | 187/19 |
| 636,809 | 11/1899 | Keenan | 187/19 |
| 920,200 | 5/1909 | Slavin | 187/6 |
| 1,716,268 | 6/1929 | Gosciewski | 182/82 |
| 1,902,946 | 3/1933 | Breed | 187/19 |
| 3,804,208 | 4/1974 | Iida | 187/19 |
| 3,878,916 | 4/1975 | White | 187/19 |
| 4,350,224 | 9/1982 | Jochum | 182/141 |

*Primary Examiner*—R. P. Machado
*Assistant Examiner*—Alvin C. Chin-Shue
*Attorney, Agent, or Firm*—Michael J. Striker

[57] ABSTRACT

A fire-proof rescue system for high-rise buildings comprises an upright rail fixed to a face of the building and a rescue cabin movable upwardly and downwardly of the building and having a gear engageable with the rail. The system further includes a gear transmission unit, a cable drum with a cable thereon, and a deflecting roller mounted above the rail and operative for taking up the cable from the cable drum.

5 Claims, 2 Drawing Figures

RESCUE SYSTEM ON HIGH-RISE BUILDINGS

BACKGROUND OF THE INVENTION

The present invention relates to fireproof rescue systems on high-rise buildings, and more particularly to rescue systems of the type having an upright climb rail mounted on the face of the building and equipped with a rack, a rescue cabin provided with guide elements and a transmission gear engaging the rack, and a drive for the transmission gear.

The rescue systems of the type under consideration are enclosed in the U.S. patent applications, Ser. No. 156,635 of Jocheem et al filed June 4, 1980 (now U.S. Pat. No. 4,350,224) and Ser. No. 243,341 of Kostede and assigned to the same assignee. The entire disclosures of the cited applications are incorporated herein by reference.

The rescue systems of the type under discussion further include a cable drum with a cable wound thereon and a cable winch which takes up the cable from the drum and affects driving of the cabin in upward and downward directions.

SUMMARY OF THE INVENTION

It is an object of the invention to provide an improved rescue system.

Another object of the invention is to provide an independent rescue system with a high degree of safety.

Still further object of the invention is to provide a rescue system which efficiently functions under any operational conditions.

These and other objects of the invention are attained by a device for rescuing persons from a high-rise building, comprising an upright climb rail mounted on a face of the building and having an elongated rack, a rescue cabin provided with a gear engageable with said rack; drive means for said gear; a transmission unit interconnected between said gear and said drive mean; said drive means including a cabin drum operatively connected to said transmission unit and having a cable wound thereon; and a deflector roller arranged against said face wall at the most possible highest location relative thereto and rigidly connected to said face wall, said deflecting roller being adapted to take up the cable from said drum.

The deflecting roller may be in a modified construction formed as a cable winch.

The transmission unit may be a gear transmission unit equipped with a motor and connected to the climb gear and to the cable drum, respectively.

The deflecting roller may be positioned above the climb rail.

The gear may be ridiidly secured to a shaft connected to the gear transmission unit and the cable drum may be afixed to a second shaft also connected to the gear transmission unit whereby the rotation of the drum is affected by the operation of the gear transmission unit.

The cable winch may be positioned below the rescue cabin so that the cable is pulled downwardly while the cable is moved in the upward direction.

It should be noted that in the rescue device in accordance with the invention the weight of the rescue cabin is absorbed by the cable. This takes place independent on whether the cable winch is located above or below the deflecting roller. It is advantageous when the deflecting roller serves as a cable winch.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
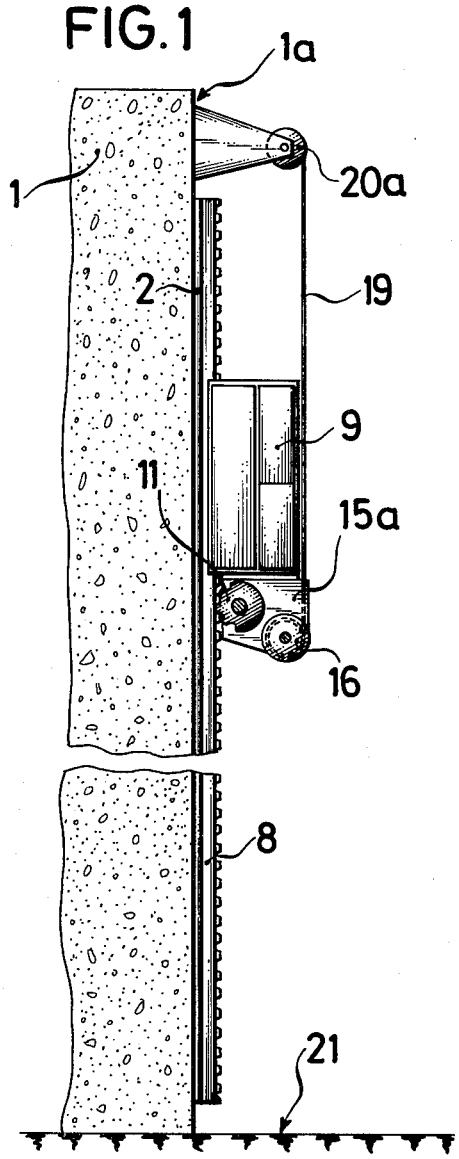
FIG. 1 is a side view of a rescue cabin in accordance with invention.
Figure 2:
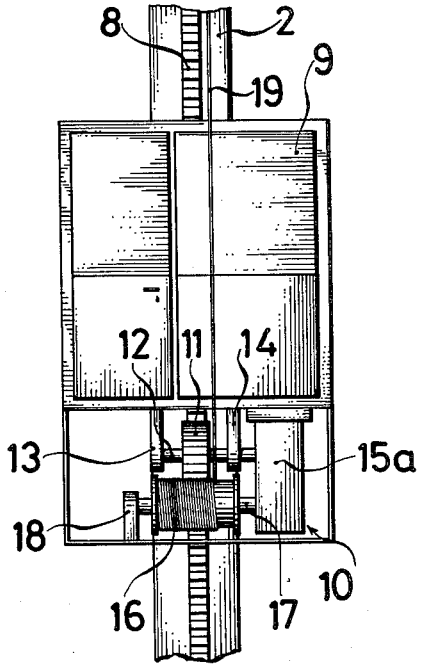
FIG. 2 is a partial front view of the arrangement illustrated in FIG. 1.

A face wall 1*a* of a high-rise building 1 carries a climb rail 8 which is secured to the building by means of an elongated plate 2. The climb rail 8 is formed as a rack and serves for driving a cabin 9 up and down. In the illustrated embodiment, a drive 10 for moving the cabin is positioned below the cabin 9. It is to be understood that this drive may be located as well on the roof of the cabin.

The important element of the drive 10 is a gear 11 which is connected to a shaft which in turn is supported for rotation in bearings 13 and 14. The gear 11 engages the upright rack 8 to move the cabin 9 upwardly and downwardly in response to the direction of rotation of gear 11.

A separate transmission gear unit 15*a* is provided in the drive, which unit is coupled to shaft 12 to affect the speed and direction of rotation of the gear 11. The transmission gear unit 15*a* is further connected to a shaft 17. The operation of the gear unit 15*a* is affected by an electric motor (not shown) coupled to any suitable electrical power source.

The drive 10 is arranged as a cable drive which includes a cable drum 16 rigidly connected to the shaft 17 which is supported at its free ends in bearings 18. Cable or rope 19 which is wound on the drum 16 is guided to a deflecting roller 20*a* which is mounted on the building face wall 1*a* and connected thereto by any conventional fastening means with the aid of brackets or the like. The deflecting roller 20*a* is positioned against the face wall of the building at the most possible highest location. In the illustrated embodiment the deflector roll is formed as a cable winch.

It is to be realized that the cable winch may be arranged on the surface of the street pavement 21 and fixedly connected thereto or mounted at any other suitable location. It is essential, however that cable 19 should be guided in the upward direction.

It will be understood that each of the elements described above, or two or more together, may also find a useful application in other types of rescue system for high-rise buildings differing from the types described above.

While the invention has been illustrated and described as embodied in a rescue system for high-rise buildings, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rescue device for evacuating persons from a high-rise building, comprising an upright climb rail mounted on a face wall of the building and having an elongated rack; a movable rescue cabin provided with a gear engageable with said rack; drive means and a transmission unit interconnected between said gear and said drive means for moving said cabin upwardly and downwardly along said rack, said drive means including a cable drum connected to said transmission unit for rotation of said drum and having a cable wound thereon; and a deflecting roller positioned above said rail and secured to said face wall at the highest possible location thereto, said cable being taken up by said roller from said cable and guided from said drum in the upward direction to and about said deflecting roller so that the weight of the rescue cabin during its movement upwardly and downwardly is at least partially absorbed by said cable.

2. The device as defined in claim 1, wherein said deflecting roller is a cable winch.

3. The device as defined in claim 1, wherein said transmission unit is a gear transmission unit.

4. The device of claim 3, wherein said gear is rigidly supported on a first shaft connected to said gear transmission unit.

5. The device of claim 4, wherein said cable drum is rigidly supported on a second shaft connected to said gear transmission unit.

* * * * *